US006460320B2

(12) United States Patent
Schierz et al.

(10) Patent No.: US 6,460,320 B2
(45) Date of Patent: Oct. 8, 2002

(54) YARN WHICH EXPANDS UPON HEATING, AND METHOD FOR ITS MANUFACTURE

(75) Inventors: Claus Schierz, Freiberg; Bernhard Kohlsdorf, Niederschöna, both of (DE)

(73) Assignee: ASGLAWO GmbH Stoffe zum Dämmen und Verstärken, Hilbersdorf (DE)

( * ) Notice: Subject to any disclaimer, the term of this patent is extended or adjusted under 35 U.S.C. 154(b) by 0 days.

(21) Appl. No.: 09/796,866

(22) Filed: Mar. 1, 2001

(65) Prior Publication Data

US 2002/0056264 A1 May 16, 2002

(30) Foreign Application Priority Data

Nov. 11, 2000 (DE) ..... 100 55 966

(51) Int. Cl.[7] ..... D02G 3/36; D02G 3/02
(52) U.S. Cl. ..... 57/3; 57/210
(58) Field of Search ..... 28/219, 220, 240; 57/210, 216, 220, 222, 224, 225, 226, 227, 228, 229, 243, 244, 245, 246, 3, 5, 6, 284, 285, 286, 287, 288, 289

(56) References Cited

U.S. PATENT DOCUMENTS 5,217,495 A * 6/1993 Kaplan et al. ..... 623/13
5,568,719 A * 10/1996 Proctor ..... 57/225
5,802,828 A * 9/1998 Adorno ..... 57/232

FOREIGN PATENT DOCUMENTS

WO WO 00/36284 6/2000

* cited by examiner

*Primary Examiner*—Danny Worrell
*Assistant Examiner*—Shaun R Hurley
(74) *Attorney, Agent, or Firm*—Collard & Roe, P.C.

(57) ABSTRACT

A yarn that expands upon heating comprises a plurality of voluminous, thermally stable individual threads or filaments, which are compacted to form a bundle and aligned in parallel, and a casing for the bundle made of a material having a lower thermal stability than the individual filaments, which decomposes upon heating. A method for producing the yarn is also provided.

16 Claims, No Drawings

YARN WHICH EXPANDS UPON HEATING, AND METHOD FOR ITS MANUFACTURE

BACKGROUND OF THE INVENTION

1. Field of the Invention

The invention relates to a yarn or thread that expands upon heating. The yarn is especially intended for the manufacture of flat structures that are suitable for use as bedding mats for supporting exhaust gas catalysts in motor vehicles. Such bedding mats are arranged along the periphery of the ceramic body carrying an exhaust gas catalyst, and seal the annular gap between the ceramic carrier body and a metallic catalyst housing. Such bedding mats are expected to permit safe and shock-free bedding of the ceramic carrier body and have to compensate for any change occurring in the width of the annular gap to be sealed when the metallic catalyst housing expands at the operating temperature determined by the combustion exhaust gases.

2. The Prior Art

A mechanically solidified bedding mat made of textured yarns is known from Patent WO 00/36284. The yarns are fixed under tensile stress in the flat structure by quilting seams. The quilting seams are produced with a sewing thread whose thermal stability is lower than the operating temperature of the bedding mat. The quilting seams are destroyed when the bedding mat is heated. Deformation energy on the textured yarn is thereby released and the volume of the bedding mat increases. The expansion property of the bedding mat results from laying the textured yarns under tensile stress as they are being processed further to produce a mat. This tensile stress is mechanically fixed, and the possibilities available for manufacturing and conditioning these mats using this technique are restricted.

SUMMARY OF THE INVENTION

The invention provides a yarn from which fabrics, mats, knitted structures and similar flat structures can be manufactured that expand upon heating, and which can be used, for example as bedding mats for bedding exhaust gas catalysts in motor vehicles. The increase in volume is to be independent of the way in which the yarn is tied into the flat structure. Conventional methods for textile processing are to be applicable according to the invention.

It is an object of the invention to provide a yarn that expands upon heating. The yarn comprises a plurality of voluminous, heat-resistant individual filaments, which are aligned in parallel and compacted to form a bundle, and a casing for the bundle made of a material which has a lower thermal stability than the individual filaments, and which decomposes upon heating. Voluminous individual filaments means yarns having a textile appearance, preferably textured yarns. Such yarns are voluminous and have high elasticity. It is essential to the invention that such yarns are aligned in a bundle in parallel with each other and not twisted with each other. They are compacted under radial pressure and/or tension to form a bundle with high packing density, and fixed by the encasement of the bundle. Fabrics, mats, knitted or similar flat structures can be produced from the yarn on conventional textile processing machines.

The thermal stability of the yarn casing is lower than the temperature at which the yarn is used. When the yarn is heated for the first time to a temperature at which it is used, which is higher than the thermal stability of the casing, the casing is destroyed, and the deformation energy of the textured individual filaments stored in the bundle is released.

The released deformation energy causes an expansion of the yarn, and the volume of the flat structure made from the yarn increases accordingly.

DETAILED DESCRIPTION OF PREFERRED EMBODIMENTS

The individual filaments bundled to form the yarn as defined by the invention preferably comprise a textured yarn made of inorganic staple fibers or filaments. Suitable thermally stable or heat-resistant materials primarily include textile glass fibers, basalt fibers, $SiO_2$-fibers, quartz fibers and aluminum silicate fibers. Textured individual filaments or fibers made of other inorganic or organic materials that are heat-stable up to at least 400° C. may also be used. The casing for the bundle usefully has at least one fiber, such as sewing thread that is guided around the bundle, and it may be basketweaved. The casing preferably consists of cotton or viscose fibers. Other materials whose temperature resistance does not substantially exceed 200° C. may also be used. Preferred are materials that can be easily processed in terms of textile engineering. The diameter of the encased bundle usefully is between 3 to 12 mm, with a diameter of about 6 mm being particularly preferred.

The expanding effect of the yarn as defined by the invention can be enhanced by adding an expanding agent such as, for example vermiculite, mica and/or graphite. The temperature-resistant individual filaments may have a coating made of an expanding material. Furthermore, the bundle may contain a core of expanding material that is surrounded by the individual filaments.

A method for producing the thread described above is an object of the invention as well. According to the invention, a multitude of voluminous, thermally stable individual filaments are guided in parallel through a collecting nozzle and compacted into a bundle in this process. Upon exiting from the collecting nozzle, the bundle is encased with a material that has a lower thermal stability than the individual threads and decomposes upon heating. Upon exiting from the collecting nozzle the encasing thread is preferably sewn round the bundle or the bundle is provided with a basket-weave or wickerwork encasement. An expanding material may be fed into the nozzle as the individual filaments are being bundled. The expanding material is preferably added in the form of a separate strand of material and forms the core of the bundle.

The yarn as defined by the invention can be processed to form fabrics, mats, knitted and similar flat structures. If it is processed to form a mechanically solidified mat, it is possible to reinforce the expansion effect even more by highly pre-compacting the mat with a sewing thread made of a material with low thermal stability. The sewing thread is then destroyed when the mat is heated, and deformation energy resulting from such pre-compacting is released, so that the expansion effect resulting from the increase in the volume of the yarn is intensified even more. A preferred application of the yarn as defined by the invention is its processing to form flat structures that are employed as bedding mats for bedding exhaust gas catalysts in motor vehicles.

Accordingly, while a few embodiments of the present invention have been shown and described, it is to be understood that many changes and modifications may be made thereunto without departing from the spirit and scope of the invention as defined in the appended claims.

What is claimed is:

1. A yarn which expands upon heating comprising:

(a) a plurality of voluminous, thermally stable fibers aligned parallel with each other and compacted to form a bundle; and (b) a casing around the bundle comprising a material having a lower thermal stability than said fibers, said casing decomposing upon heating; and (c) a core of expanding material surrounded by said fibers in said bundle.

2. The yarn according to claim 1 wherein said fibers comprise textured inorganic staple fibers.

3. The yarn according to claim 1, wherein said fibers consist of fibers selected from the group consisting of textile glass fibers, basalt fibers, $SiO_2$ -fibers, quartz fibers and aluminum silicate fibers.

4. The yarn according to claim 1, wherein said casing comprises at least one fiber guided around the bundle.

5. The yarn according to claim 1, wherein said casing is woven.

6. The yarn according to claim 1, wherein said casing comprises cotton or viscose fibers.

7. The yarn according to claim 1, wherein the encased bundle has a diameter between 3 to 12 mm.

8. The yarn according to claim 7, wherein the diameter of the encased bundle is about 6 mm.

9. The yarn according to claim 1, wherein each fiber is coated with an expanding material.

10. The yarn according to claim 9, wherein said expanding material is selected from the group consisting of vermiculite, mica and graphite.

11. The yarn according to claim 1, wherein said expanding material is selected from the group consisting of vermiculite, mica and graphite.

12. A method for producing a beat expanding yarn comprising the steps of:

(a) guiding a plurality of voluminous, thermally stable fibers in parallel through a collecting nozzle to compact the fibers into a bundle; and (b) encasing the bundle upon exit from the nozzle with a heat-decomposable material having a lower thermal stability than the fibers.

13. The method according to claim 12, wherein the step of encasing the bundle comprises guiding a fiber around the bundle upon exit from the nozzle.

14. The method according to claim 12, wherein the step of encasing the bundle comprises weaving a casing for the bundle upon exit from the nozzle.

15. The method according to claim 12, wherein each fiber is coated with an expanding material.

16. The method according to claim 12, further comprising the step of feeding an expanding material into the collecting nozzle as the fibers are being bundled.

* * * * *